US007017227B2

(12) United States Patent
Scott

(10) Patent No.: US 7,017,227 B2
(45) Date of Patent: Mar. 28, 2006

(54) VACUUM CLEANER DUSTING ATTACHMENT

(76) Inventor: John B. Scott, 6273 Whispering Oaks Dr., Eden Prairie, MN (US) 55346

( * ) Notice: Subject to any disclaimer, the term of this patent is extended or adjusted under 35 U.S.C. 154(b) by 305 days.

(21) Appl. No.: 10/353,157

(22) Filed: Jan. 28, 2003

(65) Prior Publication Data

US 2003/0172491 A1 Sep. 18, 2003

Related U.S. Application Data

(60) Provisional application No. 60/353,910, filed on Feb. 1, 2002.

(51) Int. Cl.
*A47L 9/04* (2006.01)

(52) U.S. Cl. ..... 15/393; 15/415.1; 15/246.2

(58) Field of Classification Search ..... 15/393–395, 15/398, 400, 415.1, 246.2

See application file for complete search history.

(56) References Cited

U.S. PATENT DOCUMENTS

| | | | | | |
|---|---|---|---|---|---|
| 1,067,802 | A * | 7/1913 | Dana | 56/32 |
| 1,694,257 | A * | 12/1928 | Hagopian | 15/395 |
| 2,243,120 | A * | 5/1941 | Pollitt | 15/395 |
| 2,562,167 | A * | 7/1951 | Bilde | 15/363 |
| 4,823,431 | A * | 4/1989 | Carpenter | 15/394 |
| 5,050,266 | A * | 9/1991 | Schneider | 15/421 |
| 5,074,008 | A | 12/1991 | Palomino, Jr. | 15/403 |
| 5,123,142 | A | 6/1992 | Miller | 15/393 |
| 6,802,104 | B1 * | 10/2004 | Redd | 15/393 |

* cited by examiner

*Primary Examiner*—Terrence R. Till
(74) *Attorney, Agent, or Firm*—Nawrocki, Rooney & Sivertson, P.A.

(57) ABSTRACT

A vacuum cleaner dusting attachment. An attachment member is connected to a vacuum cleaner hose at a first end of the attachment member. The second end of the attachment member is attached to a dusting member. The first end of the attachment member is aligned with the second end of the attachment member with respect to a longitudinal axis. The dusting member is maintained attached to the attachment member by a plurality of support members extending from the dusting member to the attachment member. The support members are configured to create a vortex for suctioning dust.

29 Claims, 11 Drawing Sheets

VACUUM CLEANER DUSTING ATTACHMENT

This application claims the benefit of Provisional App. No. 60/353,910, filed Feb. 1, 2002.

BACKGROUND

1. Field of the Invention

The present invention relates generally to the field of vacuum cleaners and cleaning devices. More specifically, the present invention relates to a dusting attachment for a vacuum cleaner hose.

2. Background of the Prior Art

Powered vacuum cleaners are utilized to clean residential and commercial buildings. Typical devices include attachments for cleaning stairs or hard to reach areas. These devices commonly include a body having a large aperture at which a vacuum cleaner hose is connected. The device may have a dense area of brush bristles surrounding at least a portion of an aperture extension at a distal end of the hose. These bristles are used to loosen or agitate particles of dirt from carpet and upholstery. However, these devices do not envision an attachment for use in dusting, such as of a hard or a delicate surface of an object.

U.S. Pat. No. 5,123,142 discloses a vacuum cleaner attachment having a tubular body covered with feathers. The tubular body has a plurality of holes therein for creating a vacuum. The feathers are attached at a same position about a lower portion of the tubular member. This limits the shapes and configurations that the vacuum attachment member may assume. Also, the feathers all extend in the same longitudinal direction as the tubular member. Thus, the feathers are only able to properly contact a surface at a certain range of contact angles in order to properly preform the dusting and vacuuming function.

U.S. Pat. No. 5,074,008 discloses a mop adapted for attachment to a vacuum cleaner. The mop has a plurality of bristles at a range of angles. Problems with this device relate to the size of the mop preventing the device from entering narrow spaces. Also, the mop must contact the surface to be cleaned in a generally planar manner making use on smaller surfaces more difficult.

A final problem with the prior art is that even with the attachment of a dusting apparatus to a vacuum, the dusting apparatus may not have sufficient suctioning from the vacuum in order to properly suction the dust into the vacuum. It would be advantageous to have a dusting apparatus having an improved suctioning mechanism.

SUMMARY OF THE INVENTION

The present invention provides a vacuum cleaner attachment for attaching to a vacuum host. The vacuum cleaner attachment has an attachment member. The attachment member is a hollow member having a first end for receiving the vacuum hose. The attachment member has a second end, opposite the first end, for receiving the dusting member. The hollow portion of the attachment member allows for communication of the vacuum hose with the dusting member.

The dusting member has a dusting portion that extends from the attachment member. The dusting portion may have a plurality of filaments or bristles extending therefrom for engaging and agitating dust and/or dirt particles on a surface to be cleaned. The dusting member has a connecting portion that is received within the second end of the attachment member.

The connecting portion of the dusting member is supported and maintained within the attachment member by a plurality of support structures. The support structures extend from an inner portion of the attachment member to an outer portion of the dusting member. The support structures form a stationary turbine within the vacuum cleaner attachment. The configuration of the support structures may create a vortex within the attachment member diffusing and creating a gentle air flow drawing in air from a greater area.

A first embodiment of the present invention has a dusting member having a hollow shaft with a plurality of apertures for receiving dust therein. A plurality of bristles extend from the dusting portion of the dusting member.

A second embodiment of the present invention has a plurality of support members that are aligned with an axis of elongation.

Another embodiment of the present invention has support members shapes are tilted with respect to axis of elongation.

Another embodiment of the present invention has support members having non-parallel sides.

Another embodiment of the present invention has curved support members.

Another embodiment of the present invention has support members having a non-linear side.

Another embodiment of the present invention has a plurality of support structures having non-planar sides.

Yet another embodiment of the present invention is a dusting member having a wand configuration.

Yet another embodiment of the present invention is a dusting member having a straight configuration.

Another embodiment of the present invention is a dusting member having a looped configuration.

Another embodiment of the present invention is a dusting member having a hooked configuration.

Another embodiment of the present invention is an adapter for adapting the first end of the attachment member to various vacuum hose sizes.

DETAILED DESCRIPTION OF PREFERRED EMBODIMENTS

Figure 1:
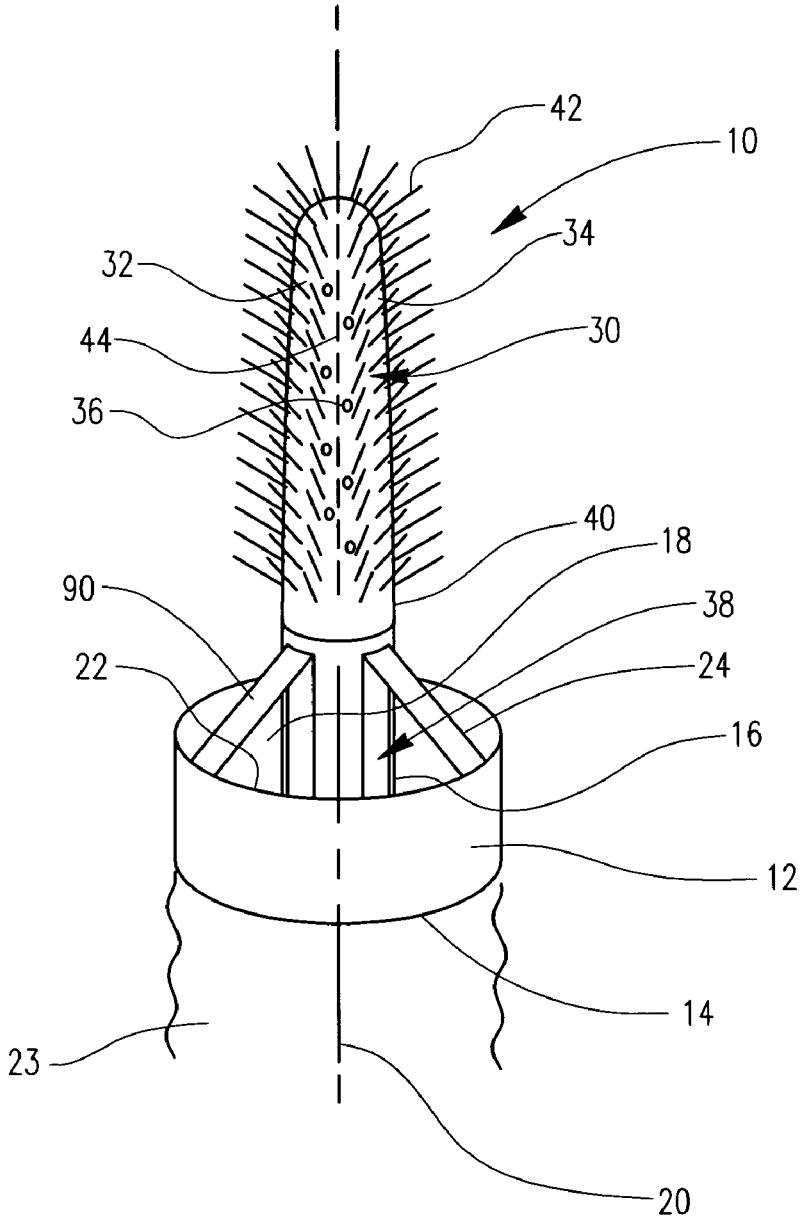
FIG. 1 is a perspective view of an embodiment of the present invention.

FIG. 1 illustrates a first embodiment of a vacuum cleaner attachment 10 according to the present invention. The vacuum cleaner attachment 10 has an attachment member 12 with a first end 14 for mating to a vacuum, and a second end 16 for receiving a dusting member 30.

The attachment member 12 is a generally cylindrical member having a central cavity 18. The cavity 18 of the attachment member extends with respect to a longitudinal axis 20 such that an inner portion of the wall 22 defining the attachment member extends longitudinally parallel to the axis 20. The first end 14 of the attachment member can engagingly receive the end or attachment portion of a vacuum hose 23. In operation, the vacuum hose 23 is able to take a suction through the cavity 18 of the attachment member.

The axis of elongation 20 extends from the first end 14 of the attachment member to the second end 16 of the attachment member. The second end 16 of the attachment member may receive the dusting member 30. The dusting member 30 has a dusting portion 32 that extends longitudinally relative to the attachment member 12. The dusting portion 32, as illustrated, may have a shaft 34 with a plurality of apertures 36 therein. The shaft 34 may be hollow such that in operation, the vacuum will be able to create a suctioning at the apertures 36 of the dusting member.

The dusting member 30 has a connecting portion 38 that extends within the attachment member 12. The connecting portion 38 of the dusting member is generally spoke-like and extends along the axis 20 of the attachment member. The outer wall 40 of the dusting member may have a lesser diameter than the inner diameter of the attachment member. A portion of the attachment member 24 may angle in a conical fashion toward the outer wall 40 of the dusting member so as to engagingly receive the dusting member 30 within the second end 16 of the attachment member.

The dusting member 30 has a plurality of filaments 42 or bristles extending from the dusting portion 32. The filaments 42 may extend outwardly or angled away from the axis 20 of the attachment member. As illustrated in FIG. 1, the filaments 42 may extend outwardly at an angle in a direction away from the connecting portion 38 as the filaments 42 extend away from the outer wall 40 of the dusting member.

A plurality of support members 50 extend radially inward from an inner wall 22 of the attachment member. The support members 50 extend from the outer wall 40 of the dusting member to the inner portion of wall 22 of the attachment member.

In use, the bristles 42 of the dusting member are able to agitate small particles such as dirt or dust that may gather on a surface. The support members 50 act as a stationary turbine for creating a vortex within the vacuum cleaner attachment 10. The vortex may allow for the suctioning of at least a portion of the small particles into the apertures 36 of the dusting member. The particles may then be suctioned further into the vacuum cleaner attachment 10 and into the bag of the vacuum, for example, so as to clean the surface.

Figure 2:
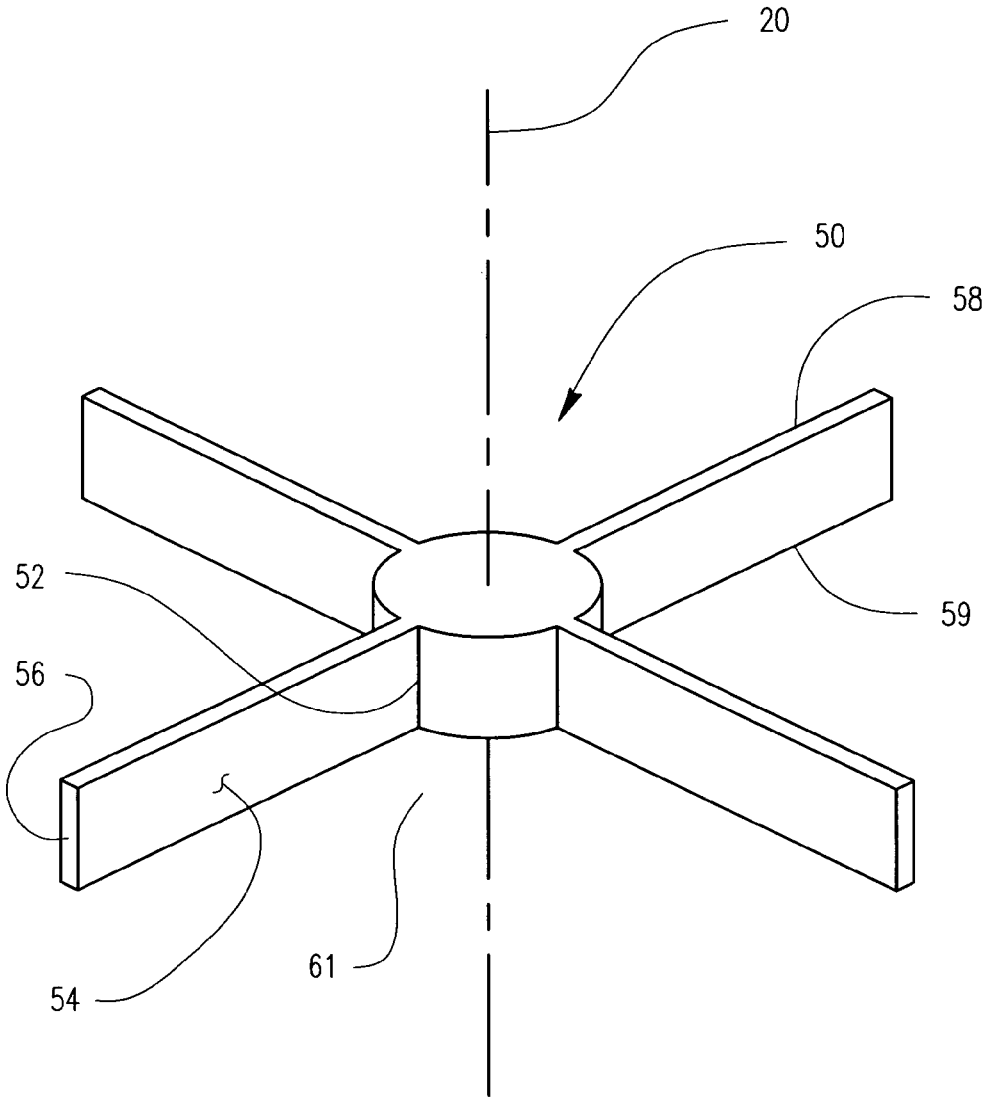
FIG. 2 is a perspective view of a plurality of associated support structures according to the present invention.

The support members 50 may have a variety of configurations for creating a vortex. A first support member configuration is illustrated in FIG. 2. The support members 50 are flat and elongate structures extending from the dusting member 30 to the attachment member 12. The support members 50 have a first end 52 for connecting to the outer wall 40 of the dusting member. The first end 52 defines a boundary of the flat surface 54 that extends radially outward from the dusting member 30. The first end 52 is substantially parallel to the axis of elongation 20. Thus, the flat portion 54 of the support member extends longitudinally substantially parallel to the axis of elongation 20. The support members 50 have a second end 56 for connecting to the inner side of wall 22 of the attachment member. In this embodiment, the second end 56 is also parallel to the axis 20. The second end 56 may, instead, have a configuration different from the first end 52.

Figure 3:
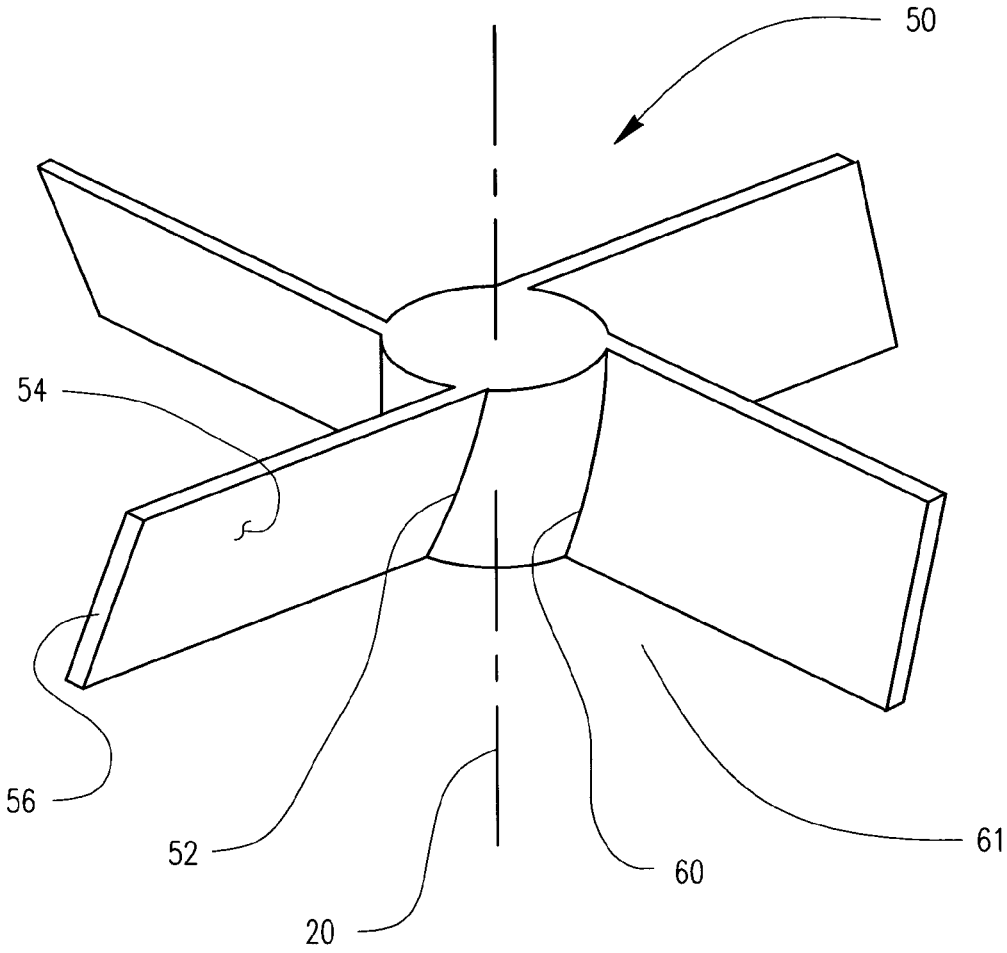
FIG. 3 is a perspective view of an alternative support structure.

FIG. 3 illustrates another embodiment of the present invention wherein the support members are twisted with respect to the axis of elongation. The first end 52 of the support member is connected to the outer wall 40 of the dusting member. The first end 52 of the support member is twisted, as at 60, with respect to the axis of elongation 20. The first end 52 forms a boundary of a twisted surface 54. Thus, the surface 54 is angled with respect to the axis 20 as it extends longitudinally from the dusting member to the attachment member.

The support members 50 have a second end 56 for connecting to the inner portion of wall 22 of the attachment member. In this embodiment, the second end 56 is angled with respect to the axis. The second end 56 may, instead, have an alternative configuration from the first side 52.

Figure 4:
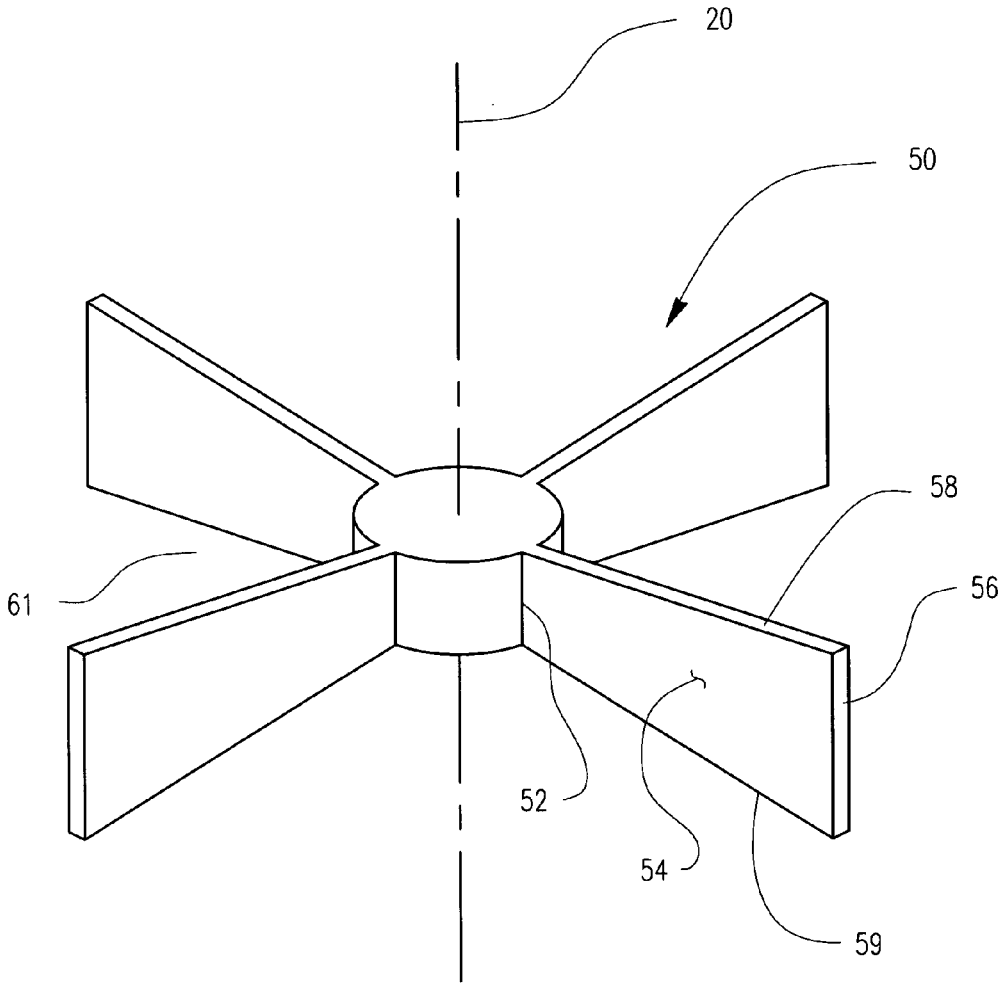
FIG. 4 is a perspective view of another alternative support structure.

FIG. 4 illustrates yet another embodiment of the present invention. In this illustration, the support members 50 have a pair of longitudinal ends 58 that are non-parallel to opposite ends. The support members 50 have a flat surface 52. The flat surface 52 has a boundary that is defined by a pair of longitudinal ends 58, 59 that extend from the dusting member 30 to the attachment member 12. In this embodiment, the longitudinal ends 58, 59 are not parallel. The opposing ends 58, 59 may converge proximate the dusting member 30 and diverge as they approach the inner portion 22 of the attachment member. Alternatively, the opposing ends 58, 59 may diverge near the dusting member 30 and converge near the inner portion 22 of the attachment member.

Figure 5:
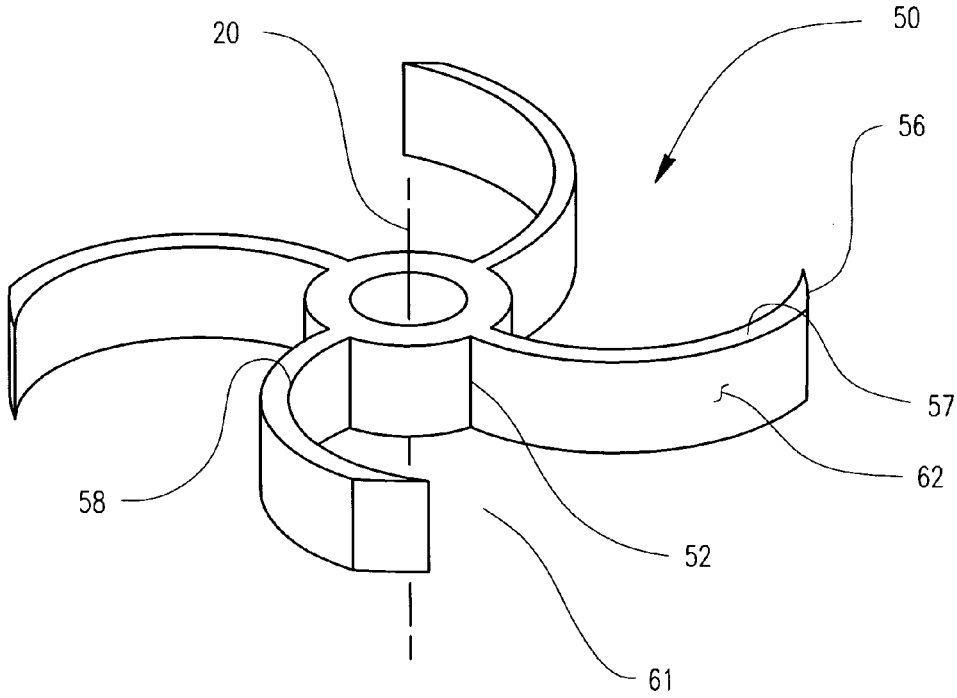
FIG. 5 is a perspective view of another alternative support structure.

FIG. 5 illustrates another embodiment of the invention wherein the plurality of support members 50 curve as they extend radially from the dusting member to the attachment member. The support members 50 have longitudinal ends 58, 59 extending from the dusting member 30 to the attachment member 12. In this embodiment, the longitudinal ends 58, 59 extend non-linearly as they progress from the outer wall 40 of the dusting member to the inner portion of wall 22 of the attachment member defining curved face 62. The curve of a first support member 63 may be about a first radius, and the curve of a second support member 64 may be about a second radius. The radii may be located such that the first support member 63 and second support member 64 curve in the same direction or such that the first support member 63 curves in a direction opposite the second support member 64. Where a plurality of support members are present, the support members 50 may alternatively curve toward and away from adjacent support members 50, or the support members 50 may all curve in a similar direction.

Figure 6:
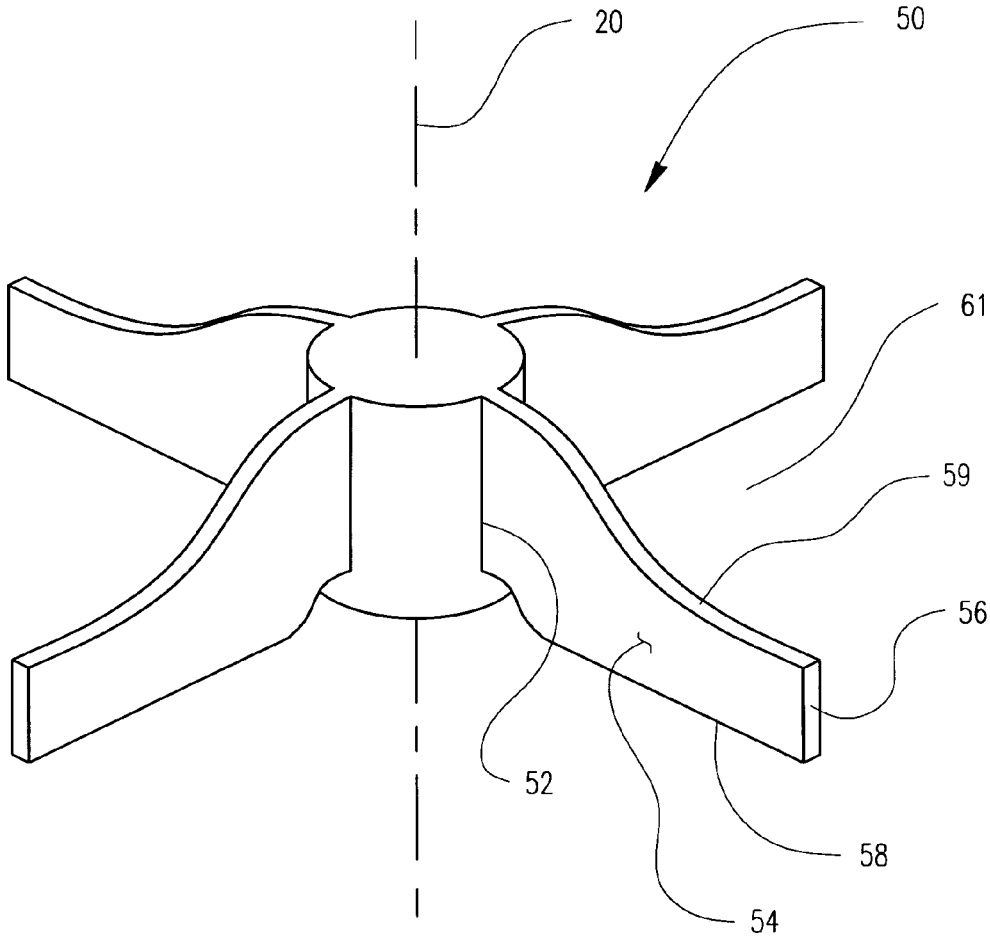
FIG. 6 is a perspective view of another alternative support structure.

FIG. 6 illustrates an embodiment of the present invention wherein each support structure has at least one longitudinal end that is nonlinear. At least one of the longitudinal ends 57 may be defined by a nonlinear, or curved, end of a support member 50. All, or merely a portion of the length of a longitudinal end may be nonlinear. Both of the pair of longitudinal ends may also be nonlinear. Alternatively, one end may be linear, and another may be curved and/or angled.

Figure 7:
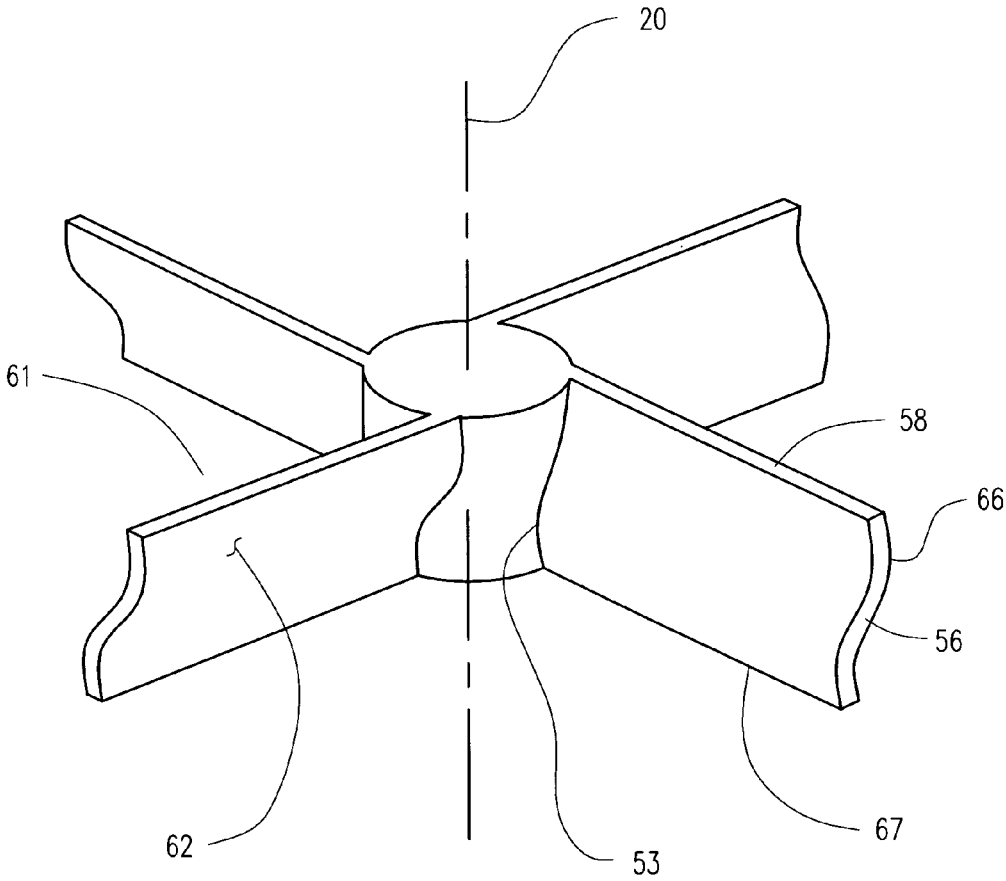
FIG. 7 is a perspective view of another alternative support structure.

FIG. 7 illustrates another embodiment of the support structures. Each of the support structures may have a first radial end 53 connecting to the outer wall 40 of the dusting member. In this embodiment, the first end 53 may be non-linear. As illustrated, the first end 53 has a curve at a location nearest the first longitudinal end 66 of the attachment member and a similar curve at an end proximate the second longitudinal end 67 of the attachment member. Alternatively, the first radial end 53 of the support member may have a combination of linear and curved portions. The curved portions may have a radius of curvature that alternates along the length of the first end 53. Each support member 50 has a second end 56 for connecting to the inner wall 22 of the attachment member. In this embodiment, the second radial end 56 is curved with respect to the axis 20. The second end 56 may, instead, have a configuration alternative to the first end 53.

It is contemplated that one of any number of support members may be utilized in light of the present invention. It is further contemplated that any combination of the characteristics of the support structures illustrated in FIG. 2–7 may be combined within the scope of the present invention.

The support members 50 are maintained in the aligned position of the dusting member 30 along the elongate central axis 20 of the attachment member. The support members 50 are, for the purposes of the present invention, for creating a vortex within the attachment member to improve suctioning of dust particles when attached to a vacuum.

Returning now to FIG. 1, an embodiment of the present invention is illustrated wherein the dusting member 30 has a wand configuration. The dusting member 30 has a dusting portion 32, for engaging and/or agitating dust and dirt particles. The dusting portion 32 has an anchor portion that extends into the attachment member 12 and is supported by the support members 50. The anchor portion is axially aligned with the axis 20 of the attachment member. The 'wand' dusting member 30 has an elongate dusting portion 32 that is axially aligned with the attachment member 12 as it extends from the second end 16 of the attachment member. The wand dusting member 30 has a wall 46 that defines a boundary between an inner hollow portion 44 and the exterior 40 of the dusting member.

A plurality of apertures 36 may be spaced about the dusting portion 32 of the dusting member. The apertures 36 extend through the wall 46. When the apparatus 10 is connected to a vacuum, the apertures 36 serve to pass dust and dirt particles therethrough. The dust particles pass through the apertures 36 and into the hollow portion 44 of the dusting member. The particles may then be suctioned through the attachment member 12 and into the vacuum hose.

The dusting member 30 has a plurality of filaments or bristles 42 extending from the dusting portion 32. It is preferred that the filaments 42 be soft and semi-pliable. However, stiffer or more pliable filaments may be utilized depending on the desired applications of the device. The filaments 42 may be attached or mounted by any suitable means. The filaments 42 illustrated in FIG. 8 extend from the dusting member 30 at an angle away from the attachment member. The filaments 42 may be attached at various angles and configurations with respect to the dusting member 30 and are not limited to the specific embodiments described herein.

The filaments 42 may be used to agitate or engage with a surface to be cleaned by a user. The filaments 42 may facilitate dust particles to be vacuumed or suctioned into the apertures 36 of the dusting member 30 or into the attachment member 12 through spaces 61 between adjacent support members 50.

Figure 8:
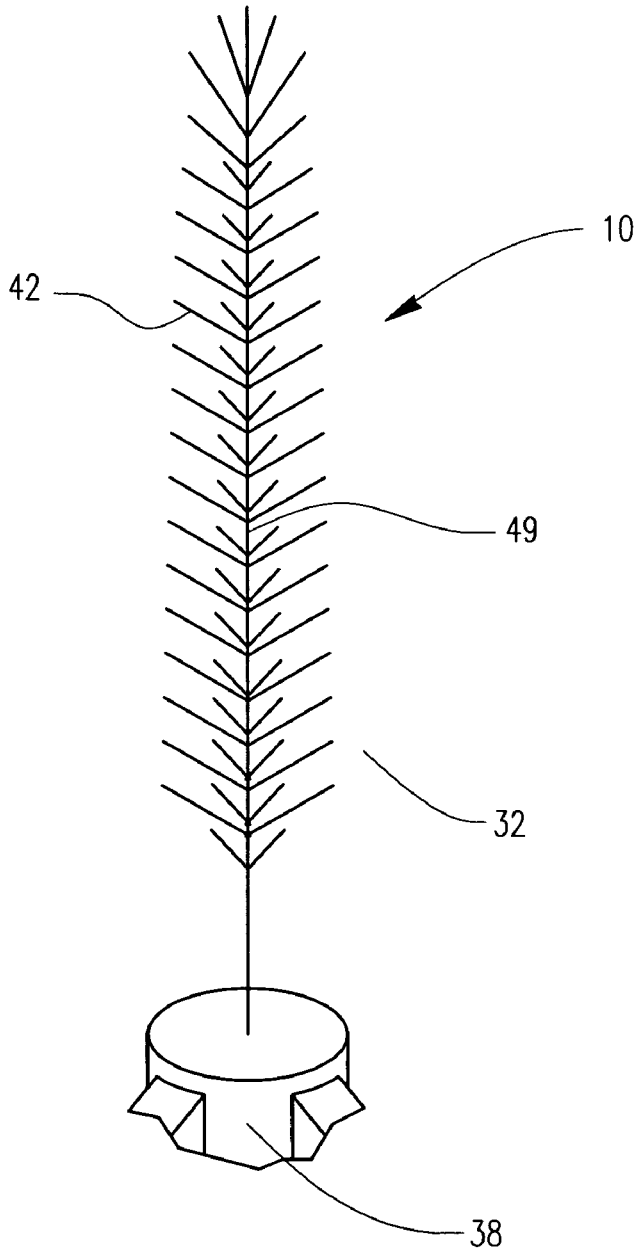
FIG. 8 is a side view of a straight dusting member in accordance with the present invention.

FIG. 8 illustrates a straight dusting member 49 wherein the dusting portion 32 is a straight elongate member. As shown, the dusting portion 32 extends from the attachment member 12 about the axis of elongation 20. A plurality of bristles 42 extend from the dusting portion 32. The bristles 42 may be angled with respect to the dusting portion 32 as they extend therefrom. In use, the apparatus 10 may be attached to a vacuum, and the bristles 42 may be brought into contact with a surface for cleaning. Dust particles from the surface may then be suctioned into the apparatus 10 such as through spaces 61 between adjacent support members 50.

Figure 9:
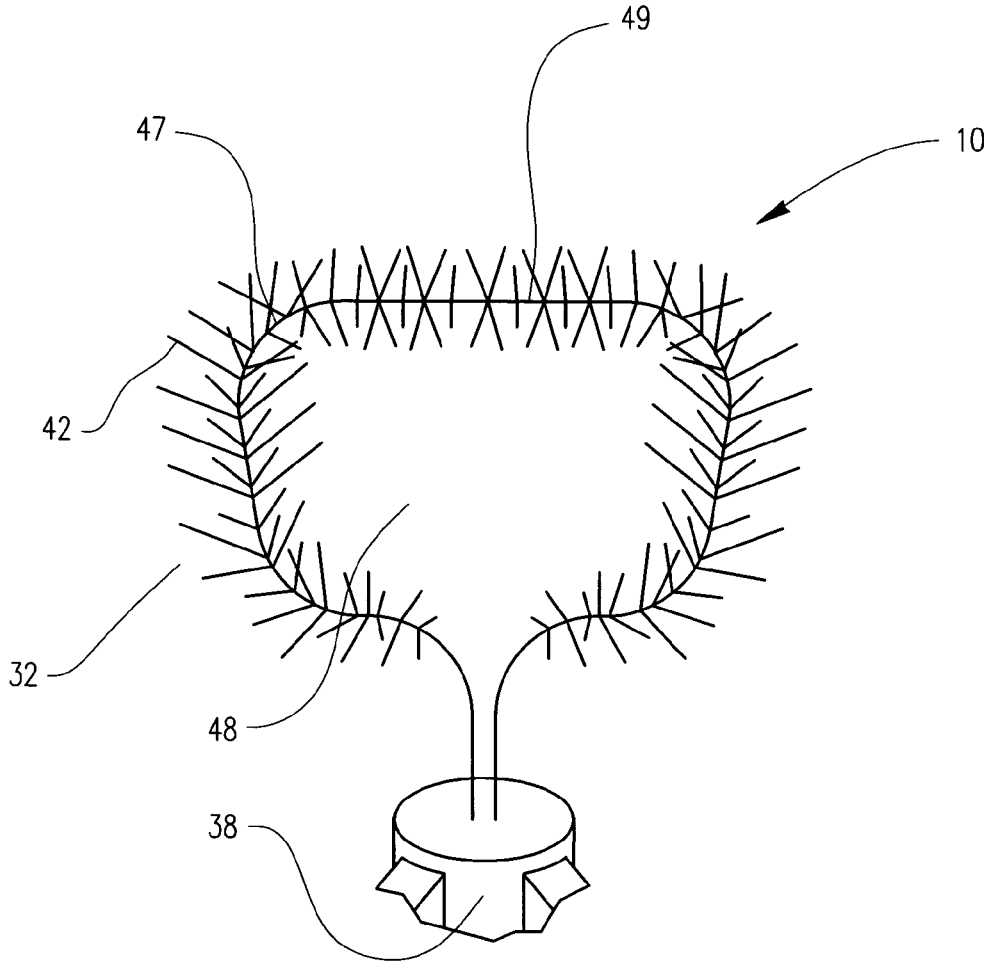
FIG. 9 is a side view of a loop dusting member in accordance with the present invention.

FIG. 9 illustrates an embodiment of the present invention wherein the dusting member is in a looped configuration. The dusting portion 32 forms a loop 48 having a plurality of bristles 42 extending therefrom. The bristles 42 extend generally outwardly from the loop 48 portion of the dusting member. Portions of the loop may be curved, as at 47, and portions of the loop may be straight, as at 49. Alternatively, the entire loop 48 may be curved. The bristles 42 of the loop are brought into engagement with a surface for cleaning. When the apparatus is attached to a vacuum, the bristles 42 engage dust particles that may be received into the apparatus 10 through the spacings 61 between adjacent support members 50, for example.

Figure 10:
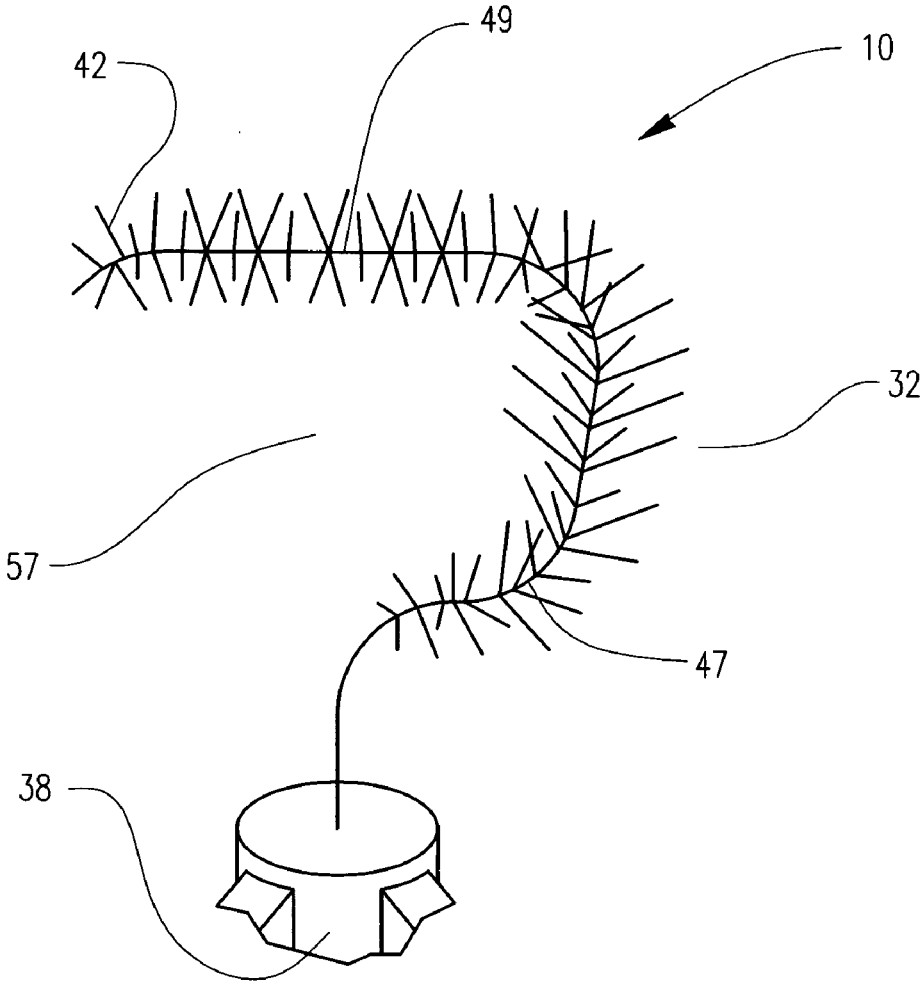
FIG. 10 is a side view of a hooked dusting member in accordance with the present invention.

FIG. 10 illustrates an embodiment of the present invention wherein the dusting member has a hook configuration 51. The dusting portion 32 of the dusting member 30 is formed in a curved configuration that continues to curve to a straight portion 49, aligned perpendicular to the axis of elongation 20 of the attachment member. The dusting portion 32 is a solid member having a plurality of filaments 42 extending therefrom.

It is contemplated that any combination of dusting member configurations disclosed herein may be combined with any combination of support members and attachment members disclosed herein to effect the purpose of the present invention. The dusting members may have curved portions and/or straight portions over one or more portions of a length of the dusting member. The dusting members may be solid or hollow. Hollow dusting members may have a plurality of apertures capable of receiving dust particles therein. The dusting members may have a plurality of filaments extending from the dusting portion. The filaments may be angled with respect to the dusting portion and/or axis of elongation. The dusting members may be made of plastic, wire, metal, or any such material suitable for the intended purpose.

Figure 11:
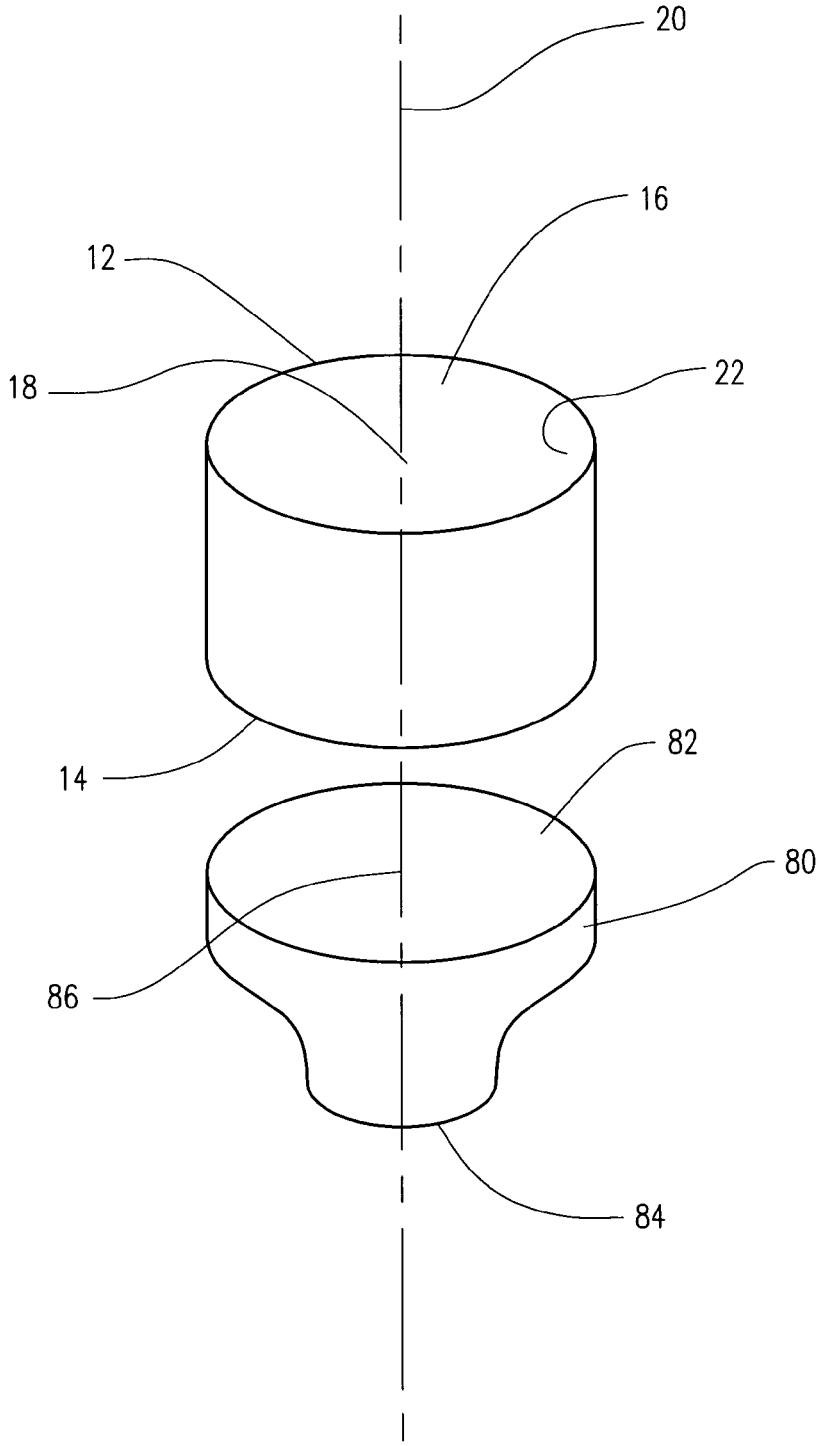
FIG. 11 is a perspective view of an adapter and attachment member.

FIG. 11 illustrates an embodiment of the present invention wherein an adapter 80 is attachable to the first end 14 of the attachment member. While the attachment member first end 14 may be sized to accommodate the end of a vacuum hose, there may be vacuum hoses of different diameters such that the first end 14 of the attachment member is not able to securely receive the vacuum hose. In such an instance, the adapter 80 may be attached to the first end 14 of the attachment member 12. The adapter 80 is a hollow member having a first end 82 for mating with attachment member 12, and a second end 84 matable with a vacuum hose. It is contemplated that a variety of adapters may be used such as to accommodate a vacuum hose having a larger diameter than the first end of the attachment member or to accommodate a vacuum hose having a smaller diameter than the first end of the attachment member. The adapter 80 has, of course, a central hollow portion 86 to allow fluid communication of the attachment member 12 with the vacuum hose.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein each of said plurality of support members has a first end in engagement with said dusting member, each of said first ends being angled relative to said axis of elongation.

2. The vacuum cleaner attachment according to claim 1 wherein each of said plurality of support members has a pair of longitudinal ends.

3. The vacuum cleaner attachment according to claim 2 wherein at least one of said longitudinal ends is non-linear.

4. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein each of said plurality of support members has a first end in engagement with said dusting member, each of said first ends extending substantially parallel to said axis of elongation; and wherein each of said plurality of support members has longitudinal ends that are non-parallel.

5. The vacuum cleaner attachment according to claim 4 wherein at least one of said longitudinal ends is non-linear.

6. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein each of said plurality of support members has a first radial end engaging said dusting member, said first radial end being non-linear.

7. The vacuum cleaner attachment according to claim 6 wherein each of said plurality of support members has a pair of longitudinal ends extending from said dusting member to said attachment member that are non-parallel.

8. The vacuum cleaner attachment according to claim 7 wherein at least one of said longitudinal ends is non-linear.

9. The vacuum cleaner attachment according to claim 6 wherein said dusting member is a wand.

10. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein said dusting member is a hook.

11. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein a portion of said dusting member has a plurality of apertures for allowing passage of dust therethrough.

12. The vacuum cleaner attachment according to claim 11 wherein a portion of said dusting member has a plurality of filaments extending therefrom.

13. The vacuum cleaner attachment according to claim 12 wherein said dusting member is made of plastic.

14. The vacuum cleaner attachment according to claim 12 wherein said dusting member is made of metal.

15. The vacuum cleaner attachment according to claim 12 wherein at least a portion of said dusting member is straight.

16. The vacuum cleaner attachment according to claim 12 wherein at least a portion of said dusting member is curved.

17. The vacuum cleaner attachment according to claim 12 wherein each of said plurality of support members has longitudinal ends extending non-linearly from said dusting member to said attachment member.

18. The vacuum cleaner attachment according to claim 12 wherein each of said plurality of supports has a first end engaging said dusting member, said first end being angled with respect to said axis of elongation.

19. The vacuum cleaner attachment according to claim 12 wherein each of said plurality of support members has longitudinal ends extending from said dusting member to said attachment member that are non-parallel.

20. The vacuum cleaner attachment according to claim 12 wherein at least one of said longitudinal ends is non-linear.

21. The vacuum cleaner attachment according to claim 12 wherein each of said plurality of support members has a radially inward first end engaging said dusting member, said first, radially inward end being non-linear.

22. The vacuum cleaner attachment according to claim 11 wherein a portion of said dusting member extending from said attachment member has a plurality of filaments extending therefrom to agitate dust.

23. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein each of said plurality of support members has longitudinal ends extending non-linearly in a radial direction from said dusting member to said attachment member.

24. The vacuum cleaner attachment according to claim 23 wherein each of said longitudinal ends has a radius of curvature.

25. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein an adapter tube is mated with said first end of said attachment member for attaching to a vacuum hose.

26. The vacuum cleaner attachment according to claim 25 wherein said dusting member defines a cavity therewithin.

27. The vacuum cleaner attachment according to claim 25 wherein said dusting member is hollow.

28. A vacuum cleaner attachment, comprising:

an attachment member having a longitudinal axis, said attachment member extending along said axis from a first end, attachable to a vacuum hose, to a second end, mounting a dusting member thereon; and a plurality of support members interconnecting said dusting member to said attachment member, said plurality of support members creating a vortex within said vacuum cleaner attachment for suctioning dust into said vacuum cleaner attachment;

wherein said dusting member is made of wire.

29. A vacuum cleaner attachment, comprising:

an attachment member having a first end matable with a vacuum hose and a second end matable with a dusting member;

said dusting member having a plurality of spaced apertures formed therein for passing dust therethrough, and a plurality of bristles for agitating dust, said dusting member having an end attachable to said attachment member; and a plurality of support members extending radially from said attachment member to said dusting member to create a vortex within said vacuum cleaner attachment for suctioning dust into said vacuum cleaner attachment.

* * * * *